US009682816B2

(12) United States Patent
Reynard et al.

(10) Patent No.: US 9,682,816 B2
(45) Date of Patent: Jun. 20, 2017

(54) INTERCONNECTOR FOR FREIGHT CONTAINERS

(71) Applicant: Duraloc Limited, Thirsk, Yorkshire (GB)

(72) Inventors: Kenneth Reynard, Thirsk (GB); Stephen Reynard, Thirsk (GB)

(73) Assignee: DURALOC LIMITED, Thrisk (GB)

( * ) Notice: Subject to any disclaimer, the term of this patent is extended or adjusted under 35 U.S.C. 154(b) by 331 days.

(21) Appl. No.: 14/358,295

(22) PCT Filed: Nov. 14, 2012

(86) PCT No.: PCT/GB2012/052821

§ 371 (c)(1),
(2) Date: May 15, 2014

(87) PCT Pub. No.: WO2013/072681

PCT Pub. Date: May 23, 2013

(65) Prior Publication Data

US 2014/0314511 A1 Oct. 23, 2014

(30) Foreign Application Priority Data

Nov. 15, 2011 (GB) ..... 1119650.8

(51) Int. Cl.
*B65D 90/00* (2006.01)

(52) U.S. Cl.
CPC .. *B65D 90/0013* (2013.01); *B65D 2590/0033* (2013.01); *Y10T 24/28* (2015.01)

(58) Field of Classification Search
CPC ..... B65D 90/0013; B65D 90/002; B65D 2590/0025; B65D 2590/0033; Y10T 24/28
See application file for complete search history.

(56) References Cited

U.S. PATENT DOCUMENTS

| | | | |
|---|---|---|---|
| 4,626,155 | A | 12/1986 | Hlinsky et al. |
| 5,193,253 | A | 3/1993 | Janke et al. |
| 5,791,808 | A | 8/1998 | Nyholm |

FOREIGN PATENT DOCUMENTS

| | | | |
|---|---|---|---|
| DE | 3538892 | A1 | 5/1986 |
| DE | 93 17 501 | U1 | 2/1994 |
| DE | 199 37 860 | A1 | 2/2011 |
| EP | 2147874 | A1 | 1/2010 |
| GB | 1356236 | A | 6/1974 |
| GB | 2 390 360 | A | 1/2004 |
| JP | 2001 171785 | A | 6/2001 |

(Continued)

*Primary Examiner* — Abigail Morrell
(74) *Attorney, Agent, or Firm* — Maschoff Brennan

(57) ABSTRACT

An interconnector for coupling together an adjacent pair of freight containers (100, 101) having ISO corner fittings (102). The interconnector has a rotatable shaft (405) and a pair of clamping heads (403, 404, 1100) provided at each end of the shaft (405). The shaft (405) is mounted within a housing (401) and the clamping heads (403, 404, 1100) are capable of axial rotation with the shaft (405) relative to the housing (401). One clamping head (403, 404, 1100) has a profiled guide surface to be rotatable by engaging contact with the ISO corner fitting (102). The clamping heads (403, 404, 1100) are biased to a clamping position by a bias actuator, such that the interconnector may be regarded as an automatic or semi-automatic twist lock interconnector.

15 Claims, 10 Drawing Sheets

(56) References Cited

FOREIGN PATENT DOCUMENTS

| | | | | |
|---|---|---|---|---|
| JP | 2003 182683 | A | 7/2003 | |
| JP | 2004018026 | A | 1/2004 | |
| JP | 2006076636 | A | 3/2006 | |
| SE | WO 8807006 | A1 * | 9/1988 | ..... B65D 90/0013 |

* cited by examiner

INTERCONNECTOR FOR FREIGHT CONTAINERS

The present invention relates to an interconnector for coupling two adjacent corner fittings of two respective freight containers end-to-end or side-by-side.

Standard freight containers usually have eight corner fittings, comprising a set of four fittings at each end of the container (one at each corner of each rectangular end of the container), and such fittings allow the containers to be clamped-down to a loading platform, or to be clamped one on top of each other in a stack of containers.

A corner fitting usually comprises a hollow casting having an entrance aperture through which can be taken the head of a coupler unit e. g. the head of a so-called twistlok unit. The head is oriented to an entry position in which is can easily pass through the entrance aperture, and is then rotated to a clamping position within the hollow casting.

The corner fittings and associated coupler units are therefore usually employed to clamp containers to the loading platform, or to one another to form the stack. However, in certain circumstances, it is desirable to be able to couple two containers together in end-to-end relationship, so that two containers can be handled subsequently as a composite unit or assembly e. g. during loading, storage and subsequent unloading operations.

The need to provide a composite unit of two containers clamped end-to-end has arisen due to the significant cost of shipping marine containers, due in part to the 'port-side crane lifts' from the dock to the ship, which are normally charged at a cost per lift. Accordingly, if two, three or four containers can be locked together end-to-end or side-by-side to form one ISO standard unit, lift costs for an assembled unit would halve the loading costs.

Horizontally adjacent containers can be clamped together using clamping devices (usually known as interconnectors), taken through the facing apertures of two adjacent corner fillings. Containers, e.g. mini containers, can be clamped together to form an ISO standard assembled container module, and while the connection needs to be robustly constructed (to withstand shear, bending, compression and tensile loads to which it may be subjected in service), a certain amount of 'play' in the engagement between each interconnector and the two corner fittings can be tolerated.

However, despite this permitted tolerance, there can in practice be handling/operating problems as a result of small misalignments in the initial securement of the corner fillings on the corners of each outer wall of the container. Accordingly, the corner fittings are welded in position at the junction between each horizontal and vertical outer frame component or 'rail' and it is necessary, as far as possible, to ensure that each outer face of a fitting is parallel, or substantially so, to the outer wall of the container to which it is adjacent.

During clamping, it is therefore important to maintain the faces substantially parallel, because any appreciable deviation makes it difficult to pass the clamping heads (of the interconnector) through the apertures, and especially makes it difficult to rotate the heads to, or from the clamping position (clamping heads usually are rotated through approximately 90° to clamp or unclamp the fitting).

Accordingly, official design tolerances are set for assembly of corner fittings according to ISO standard 1161, and which equates approximately, to tolerances of ±1° relative to strict parallel set-ups. However, even the setting of such an exacting standard (bearing in mind the environment in which welding of a corner fitting will take place), can cause operating problems in clamping/unclamping with use of existing designs of interconnector.

By way of example, various designs of interconnector are disclosed in U.S. Pat. No. 3,052,941; U.S. Pat. No. 3,261,070; FR 2046048; U.S. Pat. No. 3,726,550; WO 99/64326; DE 198 35 405; GB 2390360; U.S. Pat. No. 4,626,155; DE 3538892; JP 2006076636; EP 2147874; WO 03/106298; U.S. Pat. No. 5,193,253.

A particular problem with existing interconnectors is the practical coupling difficulties when the containers are resting on uneven surfaces, have been twisted (racked) or slightly damaged in service. In particular, and in a practical situation, a work force is required to force the containers together using heavy machinery, such as a fork lift or the like, whilst one operator locks the correctly aligned interconnectors in the region where the very heavy containers are being forced together. This presents a significant health and safety hazard for the interconnector operator in particularly when locking the upper connectors as the operator is typically required to work on a step-ladder or on top of one of the containers to reach the upper fittings. What is required is an interconnector that addresses the above problems.

Accordingly, the present interconnector has at least one biased locking head that is an automatic or semi-automatic locking head that does not require an operator to be located at the junction between the two freight containers during coupling. The automatic or semi-automatic engagement and locking action is provided by biasing at least one of the clamping heads of the interconnector into a locking position and specifically contouring the at least one biasing head so as to be rotatable on engagement with the corner fitting of a first freight container that is brought into contact with the interconnector already clamped to a second freight container.

As will be appreciated, the loading forces imparted to the interconnectors during coupling can be significant and therefore the present invention provides an automatic or semi-automatic twist lock interconnector capable of withstanding such significant loading forces whilst providing a reliable couple without manual intervention during the final mating stage of the two containers. The present interconnector is also configured to allow decoupling of the containers without requiring personnel to manually manipulate the interconnector during the decoupling operation which would otherwise pose safety risks.

According to the first aspect of the present invention there is provided an interconnector for coupling two adjacent corner fittings of two respective freight containers end-to-end or side-by-side, where each of the corner fittings has a hollow interior and an entry aperture to receive a part of the interconnector within the hollow interior, the interconnector comprising: a rotatable shaft; a housing in which the rotatable shaft is housed and capable of rotation about its longitudinal axis; a first and second clamping head provided at each respective end of the shaft, each head being rotatable about the longitudinal axis of the shaft by rotation of the shaft between a respective head entry position in which each head can pass into the respective entry aperture and a clamping position in which each head is retained within the respective hollow interior of the corner fitting; a bias actuator to bias the clamping heads to the clamping positions; wherein the second clamping head comprises a domed engaging end and a head base end that are elongate in a plane perpendicular to the longitudinal axis, the engaging end separated from the base end by a main body that extends in the longitudinal axis direction, the main body being twisted along its length to provide at least one camming surface and/or ridge extending between the engaging end and the base end; and wherein an angular orientation of the elongate domed engaging end in the plane perpendicular to the longitudinal axis is different to the angular orientation of the elongate base end in the plane perpendicular to the longitudinal axis.

Preferably, a base of the domed engaging end is defined, in part, by a pair of elongate substantially parallel edges. Optionally, the head base end is defined, in part, by a pair of elongate substantially parallel edges wherein the angular orientation of the elongate edges of the engaging end is different to the angular orientation of the elongate edges of the head base end in the respective planes perpendicular to the longitudinal axis.

Optionally, the interconnector comprises at least two camming ridges extending in the longitudinal axis between the engaging end and the head base end, a first ridge provided on a first side of the clamping head and a second ridge provided on a second side of the clamping head. Optionally, the interconnector comprises four camming ridges extending in the longitudinal axis between the engaging end and the head base end.

Preferably, the main body is twisted in the longitudinal axis direction between the engaging end and the head base end by an angle in the range 10 to 30°. Optionally, the main body is twisted in the longitudinal axis direction between the engaging end and the head base end by an angle in the range 13 to 18°. Preferably, the at least one ridge follows a helical turn about the longitudinal axis.

Optionally, a width of the main body in a direction perpendicular to the longitudinal axis between the engaging end and the head base end is substantially uniform. Optionally, a length of the elongate engaging end in a direction perpendicular to the longitudinal axis is substantially equal to a length of the elongate head base end in a direction perpendicular to the longitudinal axis. Optionally, a cross sectional area of the main body at the head base end is substantially equal to a cross sectional area of an opposite end of the main body at the interface with the domed engaging end. Alternatively, a width of the main body in a direction perpendicular to the longitudinal axis decreases from the head base end to the domed engaging end. Optionally, a length in the longitudinal axis direction of the main body is substantially equal to a length of the elongate domed engaging end in the plane perpendicular to the longitudinal axis.

Preferably, the interconnector further comprises a latch to releasably retain the first clamping head in the entry position to allow the interconnector to be decoupled from the respective corner fitting. Preferably, the latch comprises a first latch component provided at the housing and a second latch component provided at the actuator arm such that on engagement of the first and second latch components, the actuator arm is locked in position at the housing and the shaft is prevented from rotation.

According to the second aspect of the present invention there is provided an interconnector for coupling two adjacent corner fittings of two respective freight containers end-to-end or side-by-side, where each of the corner fittings has a hollow interior and an entry aperture to receive a part of the interconnector within the hollow interior, the interconnector comprising: a rotatable shaft; a housing in which the rotatable shaft is housed and capable of rotation about its longitudinal axis; a first and second clamping head provided at each respective end of the shaft, each head being rotatable about the longitudinal axis of the shaft by rotation of the shaft between a respective head entry position in which each head can pass through the respective entry aperture and a clamping position in which each head is retained within the respective hollow interior of the corner fitting; a bias actuator to bias the clamping heads to the clamping positions; wherein at least one of the first and second clamping heads is shaped so that when the clamping head is in the clamping position and the respective corner fitting and the clamping head are brought into engagement during coupling of the containers, the clamping head is rotatable by contact with the corner fitting and against the bias actuator to the entry position so as to allow the head to pass through the respective entry aperture and thereafter the head being disengaged and to be rotatable by the bias actuator to return to the clamping position; characterised by: a first latch to releasably retain the first or second clamping head in the entry position against the force of the bias actuator to allow the interconnector to be decoupled from the respective corner fitting.

Preferably, the first or second clamping head that is shaped to be rotatable on engagement with the corner fitting comprises one or a plurality of straight or curved ridges extending over an external facing region of the head to contact the corner fitting when the clamping head and the corner fitting are brought into engagement. The clamping head that comprises the straight or curved ridge(s) is referred to in this specification as a twist lock clamping head. Where the ridges are straight, the head comprises a substantially square based pyramidal structure. This head effectively comprises one or a plurality of tapered cam or camming surfaces, regions, splines or ridges. Preferably, the guide edge of the twist lock head is curved and preferably helically shaped and extends from a central region of the domed head to its outermost edge or perimeter. These guide edges are configured to contact the substantially parallel opposed edges of the entry aperture of the respective corner fitting as the corner fitting is brought into engaging contact with the twist lock head. Continued axial movement of the fitting onto the interconnector rotates the twist lock head, via the tapered helical guide edges (that extend from the head's central tip) such that the head is rotated to eventually pass through the entry aperture and into the hollow interior of the corner fitting.

By biasing the twist lock head into the clamping position, once it is inserted within the hollow interior of the corner fitting, it quickly returns, under the biasing force, to the clamping position and is then prevented from being withdrawn from the corner fitting interior and is effectively clamped in coupled relationship pending manual intervention.

Preferably, the interconnector comprises a barrel, the shaft being rotatably housed within the barrel, the interconnector further comprising a slot extending through the housing in a direction transverse or perpendicular to the shaft and an actuator arm projecting from the shaft and radially outward through the body via the slot, the actuator arm capable of reciprocating movement within the slot as the shaft rotates within the barrel.

Preferably the housing comprises a latch component and the actuator arm comprises a latch component such that on engagement of the latch components the actuator arm is locked in position at the housing and the shaft is prevented from rotation. Preferably, the housing latch component comprises a recess in an external facing surface of the housing and the actuator arm latch component comprises a body shaped to be received in the recess.

Preferably, the first and second clamping heads are coaxially aligned at the shaft and the alignment of each head in a direction perpendicular to the shaft is off-set relative to one another. In particular, the clamping heads comprise an elongate configuration and therefore have a longitudinal axis that extends perpendicular to the longitudinal axis of the shaft. Preferably, the alignment of each longitudinal axis of each clamping head is not parallel and is preferably off-set relative to one another by a small angle of 10° to 30° or more preferably 10° to 15°. According to one embodiment, this off-set angle is 12.5°. In particular, each clamping head comprises a pair of opposed elongate side edges that extend parallel to the longitudinal axis of the clamping head. These longitudinal edges have a length being slightly less than the length of opposed edges that define the entry aperture of the corner fitting. As the longitudinal axis of each clamping head is off-set by a small angle, at any one time, only one head of the pair will be positionable in the entry position with its elongate edges aligned with the opposed edges of the entry aperture.

Preferably, the bias actuator comprises a spring attached at one of its ends to the housing and the opposite end to the actuator arm. Preferably, the spring is positioned within the barrel of the housing and extends circumferentially around the shaft between an internal facing surface of the housing that defines the barrel and an external facing surface of the shaft.

Preferably, the actuator arm comprises a handle moveably mounted in a radial direction relative to the housing. Preferably, the actuator arm further comprises a bias actuator to bias the handle in a direction towards the housing.

Optionally, the housing comprises at least two parts clamped together to form a unitary body around the shaft.

A specific implementation of the present invention will now be described, by way of example only and with reference to the accompanying drawings in which.

Figure 1:
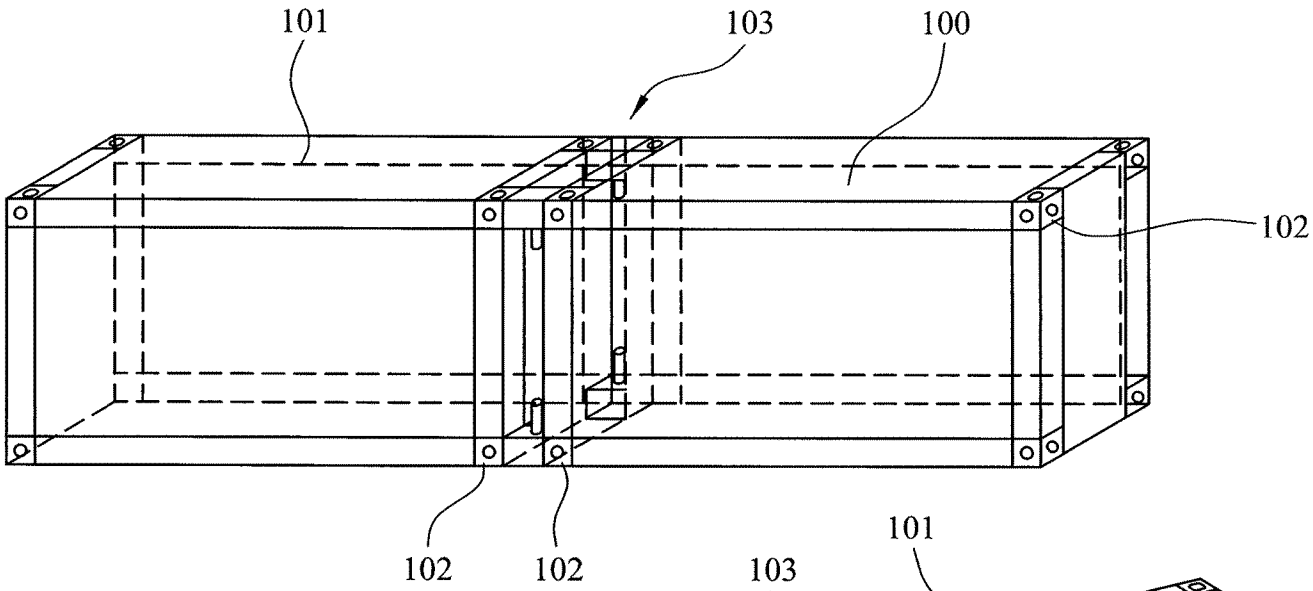
FIG. 1 is a perspective view of two freight containers clamped together in an end-to-end relationship to form a composite unit or assembly suitable for unitary handling via the interconnector according to one aspect of the present invention.
Figure 2:
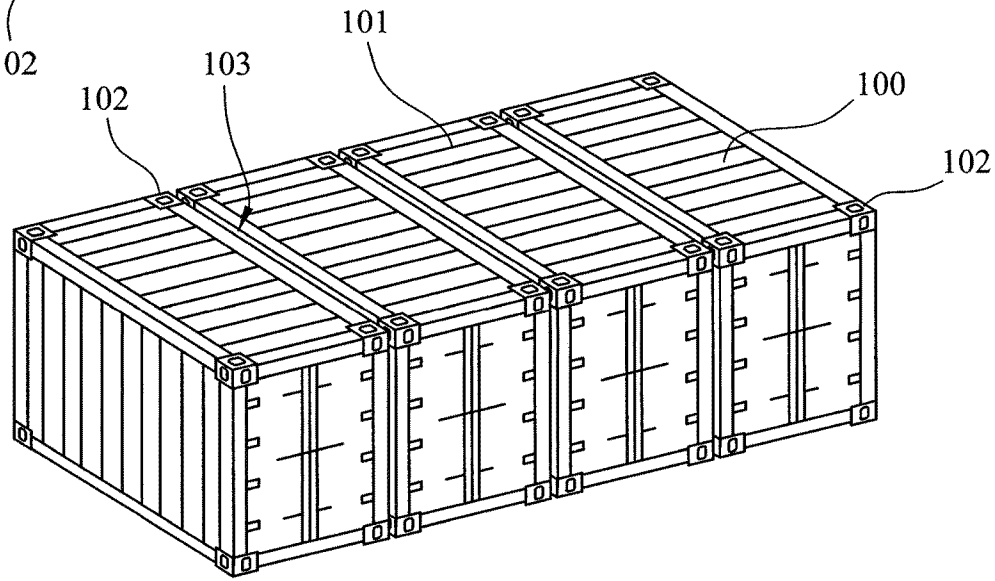
FIG. 2 is a perspective view of an assembly of four freight containers clamped together side-by-side to form a standard ISO module using a interconnector unit according to a specific implementation of the present invention.

Referring to FIG. 1, the present interconnector (coupler unit) is capable of coupling a first freight container 100 and a second freight container 101 together in end-to-end relationship to form a unitary assembly that it is then suitable for handling i.e. loading, storage and subsequent unloading at a transport vehicle. FIG. 2 illustrates a further use of the present interconnector to join and clamp together freight containers 100, 101 in side-by-side relationship to form a similar unitary structure convenient for handling. For example, and referring to FIG. 2, the freight containers 100, 101 may be mini containers clamped together to form a standard 6.1 m (20 foot) ISO module. Similarly, three or two units may be coupled together (as illustrated in FIG. 1) to form 6.1 m (20 foot) ISO module. The present interconnector is also suitable to couple two 6.1 m (20 foot) containers to form a 12.2 m (40 foot) unitary ISO unit.

Referring to FIG. 1, the facing end of freight containers 100, 101 is rectangular is cross section with a corner fitting 102 provided at each vertex. The present interconnector is configured to clamp to each corner fitting of each facing end to form the coupled section 103 as the two freight containers 100, 101 are brought together. That is, four interconnectors are used to couple the freight containers 100, 101 either in end-to-end relationship of FIG. 1 or side-to-side relationship of FIG. 2.

Figure 3:
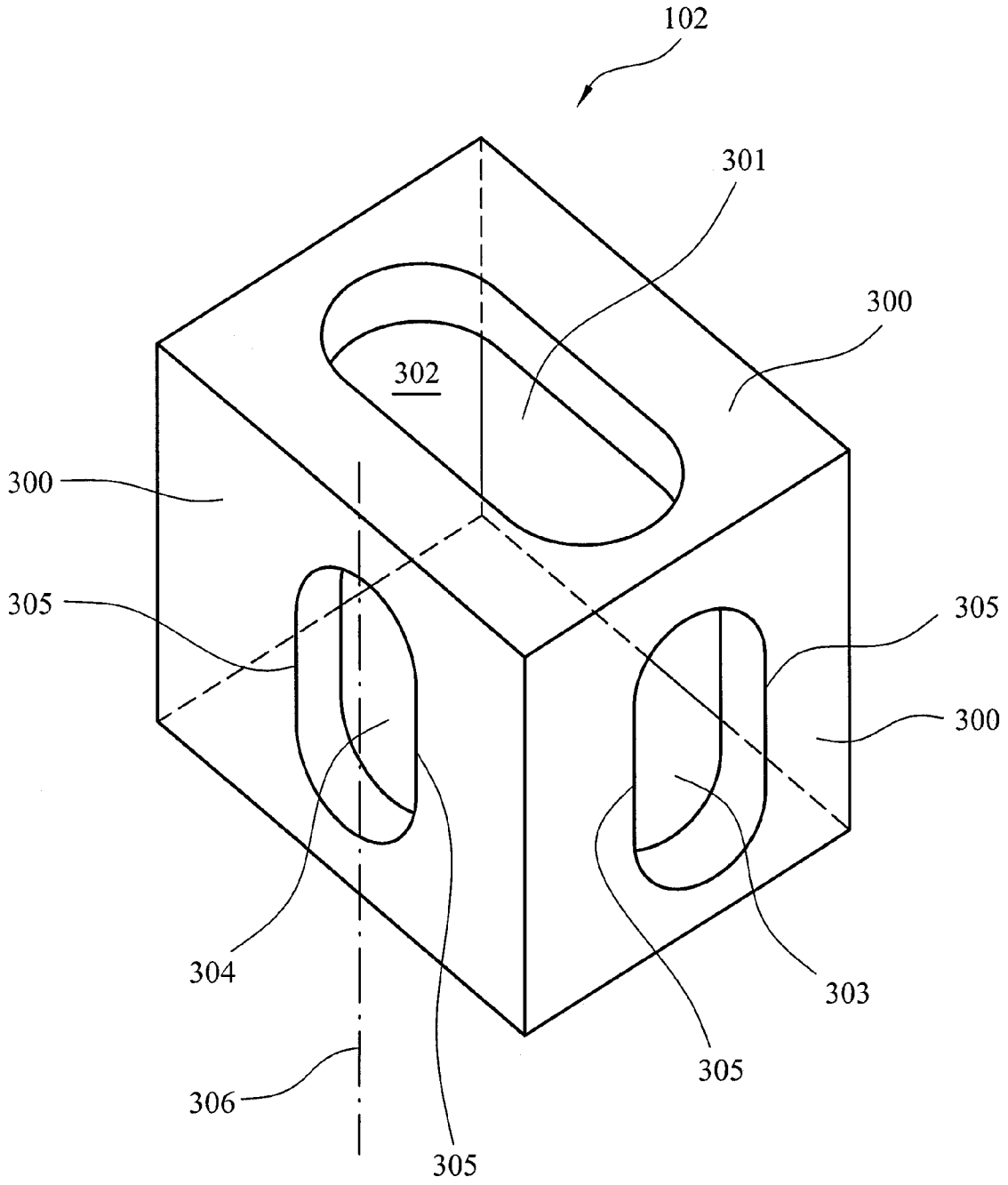
FIG. 3 is a perspective view of a corner fitting at each vertex of the freight containers of FIGS. 1 and 2 for receiving a clamping head of an interconnector according to one aspect of the present invention.

FIG. 3 illustrates a perspective view of a corner fitting 102. Each corner fitting has a cuboidal configuration with a hollow interior 302. Three entry apertures 301, 303, 304 are provided through three respective walls of corner fitting 102 to allow access into interior 302. Entry aperture 301 is typically enlarged and is provided on an upper or lower face of the corner fitting 102 relative to side entry apertures 303, 304. The enlarged aperture 301 is suitable to allow freight containers to be stacked above one another and to be raised and lowered during loading and unloading. Side entry apertures 303, 304 are typically used to secure adjacent freight containers to one another during transport or storage. The entry apertures 301, 303, 304 are provided at the external facing walls 300, with the remaining three walls of the cuboidal corner fitting 102 being internal facing relative to the freight container. Each side entry aperture 303, 304 is defined, in part, by a pair of opposed parallel or substantially parallel edges 305 on opposite sides of a longitudinal axis 306.

Figure 4:
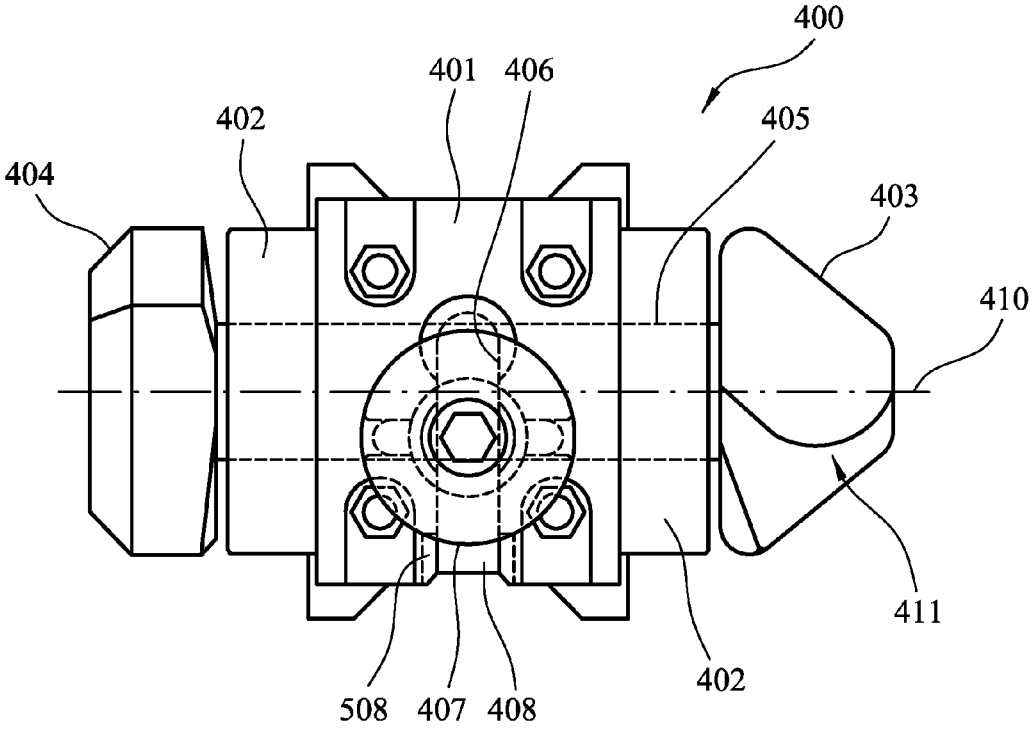
FIG. 4 is a side view of an interconnector according to one aspect of the present invention having two clamping heads positioned at each end of an elongate shaft housed within a housing.
Figure 6:
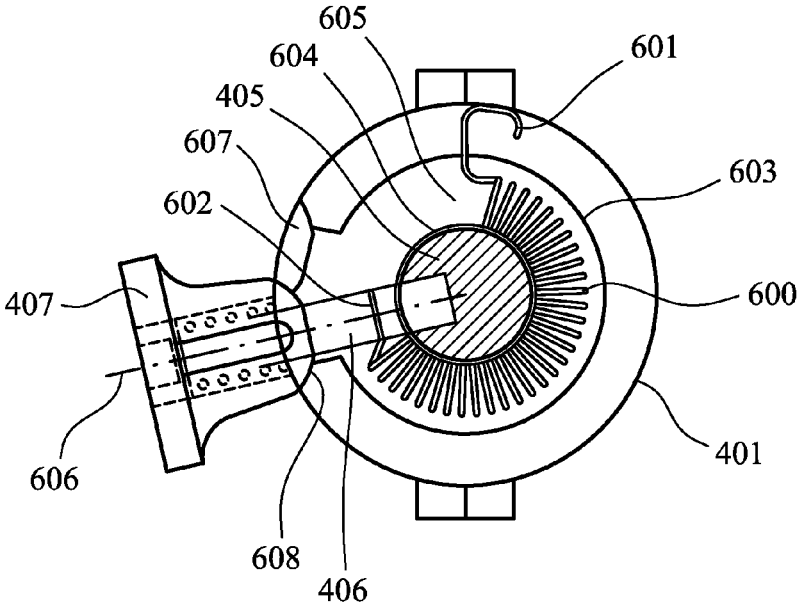
FIG. 6 illustrates a cross sectional side view of the interconnector of FIG. 5 with a biasing spring connecting the housing and a moveable actuator arm configured to rotate both clamping heads of FIG. 4.
Figure 5:
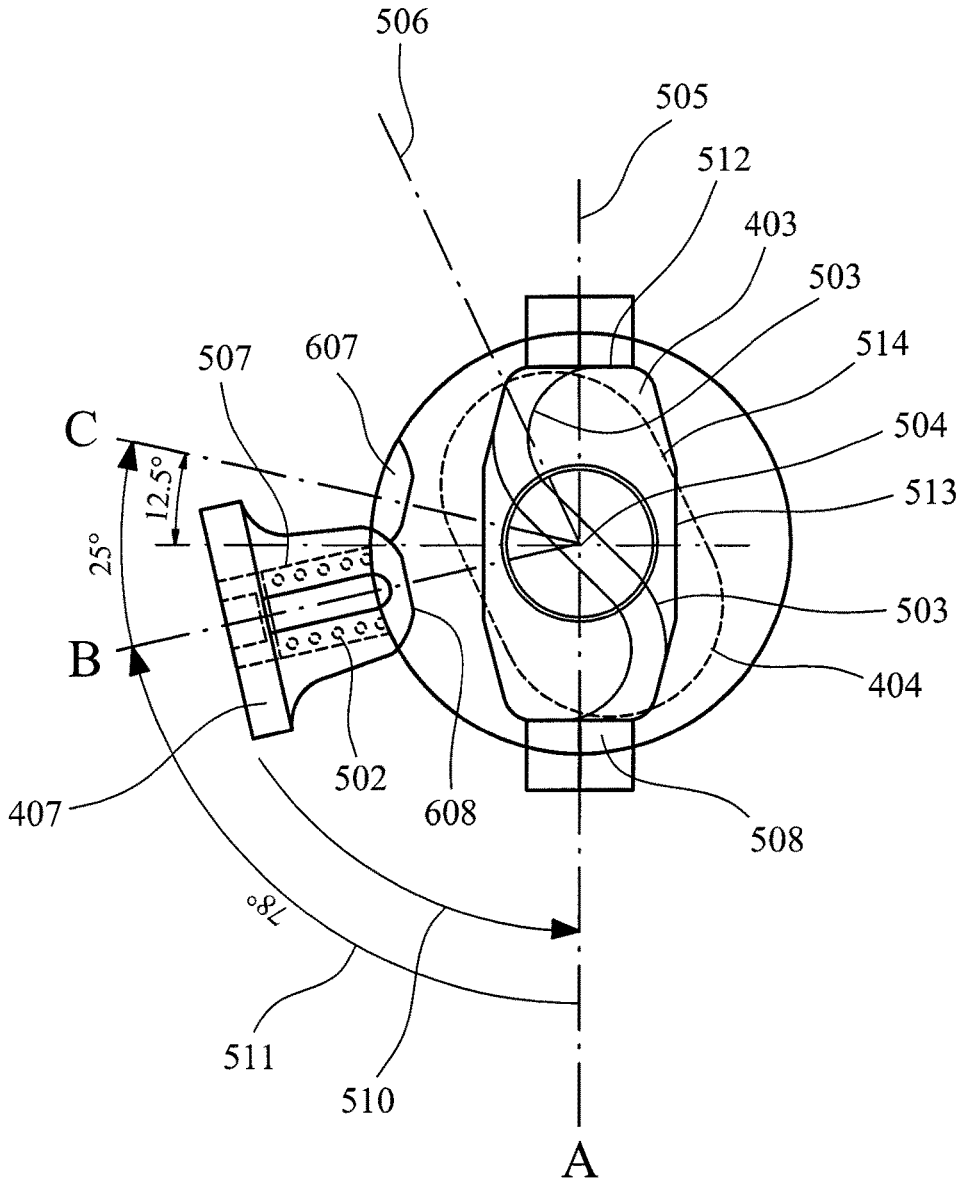
FIG. 5 is an illustration of the interconnector of FIG. 4 from the automatic or semi-automatic twist lock clamping head end.

Referring FIGS. 4 to 6, the interconnector 400 comprises a housing 401, a longitudinal shaft 405 extending within the housing and two clamping heads 403, 404 positioned at each end of shaft 405. A respective shear block 402 extends longitudinally from housing 401 over a short region of shaft 405 between housing 401 and each respective clamping head 403, 404. Housing 401 comprises an internal barrel 605 defined by a substantially cylindrical internal facing surface 603 of housing 401. Shaft 405 extends longitudinally within barrel 605 to project externally of housing 401 and each end shear block 402. Each clamping head 403, 404 is therefore mounted externally of each shear block 402 and housing 401 and is substantially permanently or rigidly attached at each end of shaft 405. Suitable bearings (not shown) are accommodated within barrel 605 to enable shaft 405 to rotate within barrel 605 which, in turn, provides rotation of each clamping head 403, 404 about the longitudinal axis 410 extending through the elongate interconnector 400.

Each clamping head 403, 404 is substantially dome shaped, having a tapered external facing surface region. However, the length of the tapered region of head 403 is greater than that of head 404, which comprises a flattened outermost region or surface whilst the outermost region of head 403 is substantially tapered. Each head 403, 404 is elongate in a direction perpendicular to the taper and is defined, in part, by a pair of substantially parallel side edges 513, 514, respectively at the base of each dome.

An actuator arm 406 is rigidly attached to shaft 405 and extends radially outward from shaft 405 through housing 401 so as to project externally from housing 401. Shaft 406 is capable of circumferential rotation about housing 401 via an elongate slot 408 extending circumferentially around a region of housing 401 perpendicular to longitudinal axis 410. A handle 407 is positioned at the external most end of arm 406 suitable to be grasped by an operator and to actuate movement of arm 406 along the length of slot 408.

Handle 407 is movably mounted at arm 406 so as to be moveable along the longitudinal axis 606 of arm 406 and radially in and out relative to housing 401. Movement of handle 407 is biased towards housing 401 via a coil spring 502 housed within an internal cavity 507 of handle 407. Accordingly, spring 502 acts via one end against arm 406 and via a second end against handle 407.

According to the specific embodiment, interconnector 400 comprises two operative latches configured to releasably lock clamping heads 403, 404 in fixed position to prevent their rotation about longitudinal axis 410. The latching mechanisms are provided by first and second recess 607, 608 indented in the outer surface of a housing 401 at the region of slot 408. The recess 607, 608 are effectively formed as radially flared regions at discrete positions along the length of slot 408. The flared profile and depth of each recess 607, 608 is configured to receive a radially innermost end of handle 407. Where handle 407 is received within each recess 607, 608, arm 406 is radially locked which, in turn, prevents axial rotation of shaft 405 and accordingly clamping heads 403, 404. According to further embodiments, the radially innermost end of handle 407 may comprise a profiled projection or region having a shape profile corresponding to a shape profile of an innermost region of latching recesses 607, 608 to provide and latchable male and female interlock mechanism.

Interconnector 400 further comprises a bias actuator in the form of a coil spring 600 accommodated within barrel 605 internally of housing 401. Spring 600 extends circumferentially around outer surface 604 of shaft 405 in the region between this external surface 604 and internal facing surface 603 of housing 401. A first end 601 of spring 600 is secured to housing 401 and a second end 602 is secured to actuator arm 406. Accordingly, rotational movement of shaft 405, each clamping head 403, 404 and actuator arm 406 is affected by spring 600. In particular, spring 600 is configured to bias actuator arm 406 and accordingly shaft 405 and heads 403, 404 in an anti-clockwise direction 510, with clockwise rotation 511 being against the torque force exerted by spring 600.

Due to the alignment of each clamping head 403, 404, with actuator arm 406 displaced to position A referring to FIG. 5, each clamping head 403, 404 is oriented in a 'clamping' position. Clockwise rotation from position A to position B of actuator arm 406 provides a rotation of clamping heads 403, 404 such that clamping head 403 is brought to an 'aperture entry' position suitable for passage through side entry aperture 303 of corner fitting 102 and into the hollow interior 302. Further clockwise rotation of actuator arm 406 provides further rotation of clamping heads 403, 404 to align clamping head 404 to a corresponding 'aperture entry' position.

Referring to FIG. 5, each clamping head 403, 404 is substantially elongate and comprises a respective longitudinal axis 505, 506. Each clamping head 403, 404 is coaxially aligned relative to longitudinal axis 410. However, each longitudinal axis 505, 506 is off-set relative to one another when viewed from each end of the interconnector 400 as illustrated in FIG. 5. This off-set orientation provides that, in use, both clamping heads 403, 404 are not configurable to be positioned in the aperture entry position at the same time which would otherwise provide unwanted premature decoupling of the two freight containers 100, 101 as detailed further below.

The present interconnector is configured to be an automatic or semi-automatic twist lock coupler device. This functionality is provided in part by the internally mounted spring 600 and a specific shape 411 of clamping head 403. In particular, the shape 411 of head 403 is configured to drive and guide rotational movement of head 403 about longitudinal axis 410 during engagement with corner fitting 102 during a coupling operation. Referring to FIG. 5, head 403 is profiled to have a pair of curved, in particular helical or spiral guide edges 503 extending from a central outermost tip region 504 to a perimeter region 512. As illustrated in FIG. 4, the same head profiling 411 is not provided at the alternate clamping head 404. However, according to further specific embodiments, head 404 may be configured with the same surface contouring 411, 503 as head 403.

Figure 7:
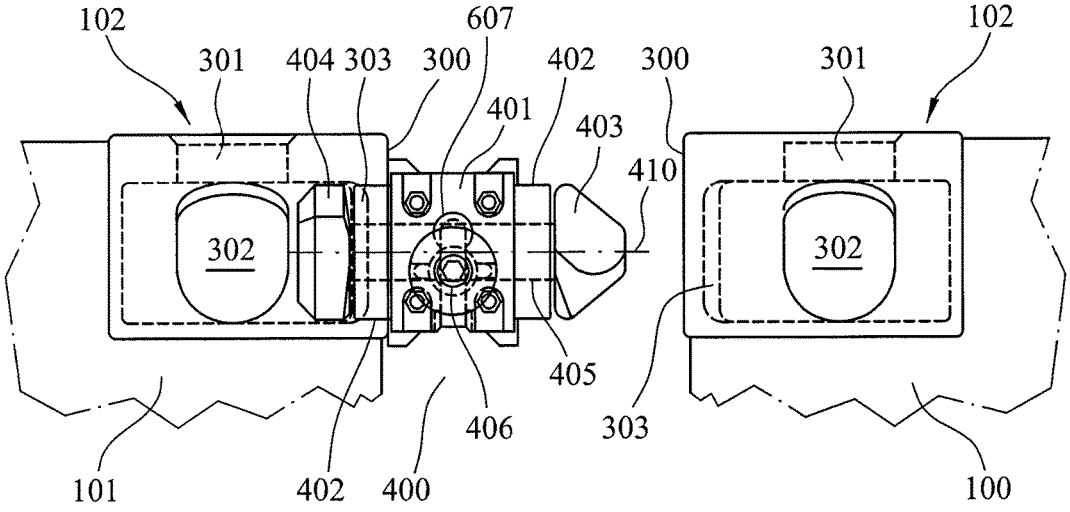
FIG. 7 illustrates the interconnector of FIG. 4 and two corner fittings in an initial 'unload' position with one clamping head inserted within a hollow interior of a first corner fitting.
Figure 8:
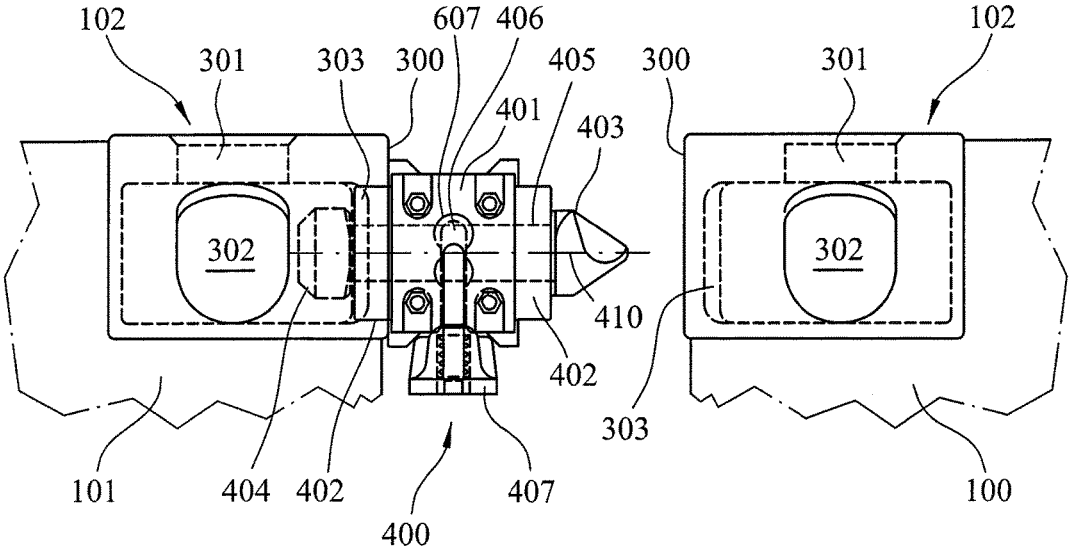
FIG. 8 illustrates the interconnector and corner fittings of FIG. 7 in a second stage 'load' position with the first clamping head and the second clamping head rotated to the 'clamping' positions.
Figure 9:
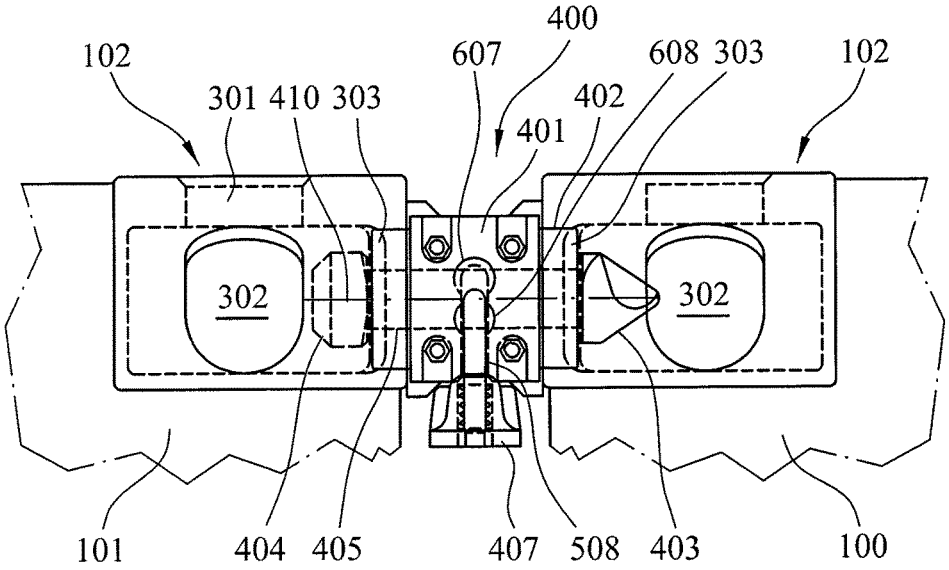
FIG. 9 illustrates a final 'clamped' position with each clamping head locked in the 'clamping' position within each respective corner fitting to provide a couple for the two adjacent freight containers of FIGS. 1 and 2.

FIGS. 7 to 9 illustrate the sequence of steps for coupling two adjacent freight containers 100, 101 into end-by-end or side-by-side relationship as illustrated in FIGS. 1 and 2. Referring to FIG. 7, interconnector 400 is first coupled to corner fitting 102 of container 101. Initially, head 404 is introduced to side entry aperture 303 when actuator arm 406 is in position C and the substantially parallel side edges 514 of head 404 are aligned substantially parallel with the opposed side edges 305 of aperture 303. Arm 406 is allowed to rotate through over 100° straight passed position B to position A, in one movement, under the torsional force of spring 600 such that head 404 is brought to the orientation illustrated in FIG. 8 with the longitudinal axis 506 extending perpendicular to the longitudinal axis 306 of aperture 303.

Referring to FIG. 8, by rotation of actuator arm 406 from position C to position A under the torsional force of spring 600, both clamping heads 404, 403 are brought to full clamping position. That is, each pair of longitudinal edges 513, 514 of each respective clamping head 403, 404, are aligned perpendicular and traverse to the opposed edges 305 of entry aperture 303. As head 404 has being introduced into the hollow interior 302 of corner fitting 102, interconnector 400 is fully clamped to freight container 101. In the configuration of FIG. 8, shear block 402 extends through the side wall of corner fitting 102 between external face 300 and an opposed internal face that defines, in part, hollow interior 302.

FIG. 8 illustrates interconnector 400 in a 'load' position ready for engaging contact with the second freight container 100 and its respective corner fitting 102. Both clamping heads 403, 404 are maintained in this load position under the torsional force of spring 600, this being the default position for each clamping head 403, 404. As container 100 is moved towards clamping head 403, face 300 and in particular the opposed edges 305 of aperture 303 contact the guide edges or ridges 503. Due to their curved profile, head 403 is caused to rotate in a clockwise direction from position A towards position B referring to FIG. 5. This rotational movement about axis 410 is against the torsional force of spring 600. As head 403 passes through entry aperture 303, as the containers 101, 100 are brought together, head 404 is also rotated but is prevented from decoupling from corner fitting 102 due to the off-set alignment of each respective longitudinal axis 505, 506. Once head 403 has cleared entry aperture 303 and is positioned entirely within hollow interior 302, spring 600 forces the actuator arm 406 and accordingly shaft 405 and heads 403, 404 to return in the anti-clockwise direction 510 towards the default lock position A of FIG. 5 and as illustrated in FIG. 9. In this configuration, both clamping heads are again aligned transverse and in particular perpendicular to the longitudinal axis 306 of apertures 303. Both freight containers 100, 101 are now coupled securely.

Figure 10:
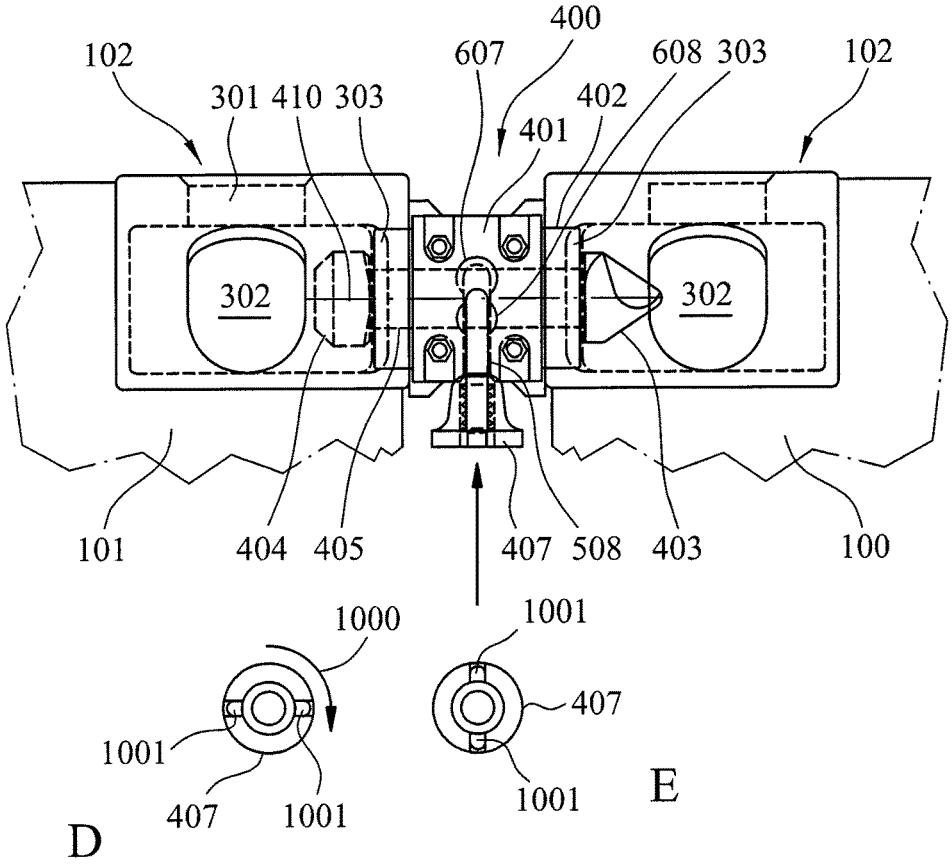
FIG. 10 illustrates the interconnector in the same final 'clamped' position of FIG. 9 but with a radially extending actuator arm and the handle orientated in a mechanical latch or lock position to prevent rotation of the clamping heads within the respective corner fittings according to a specific implementation of the present invention.
Figure 11:
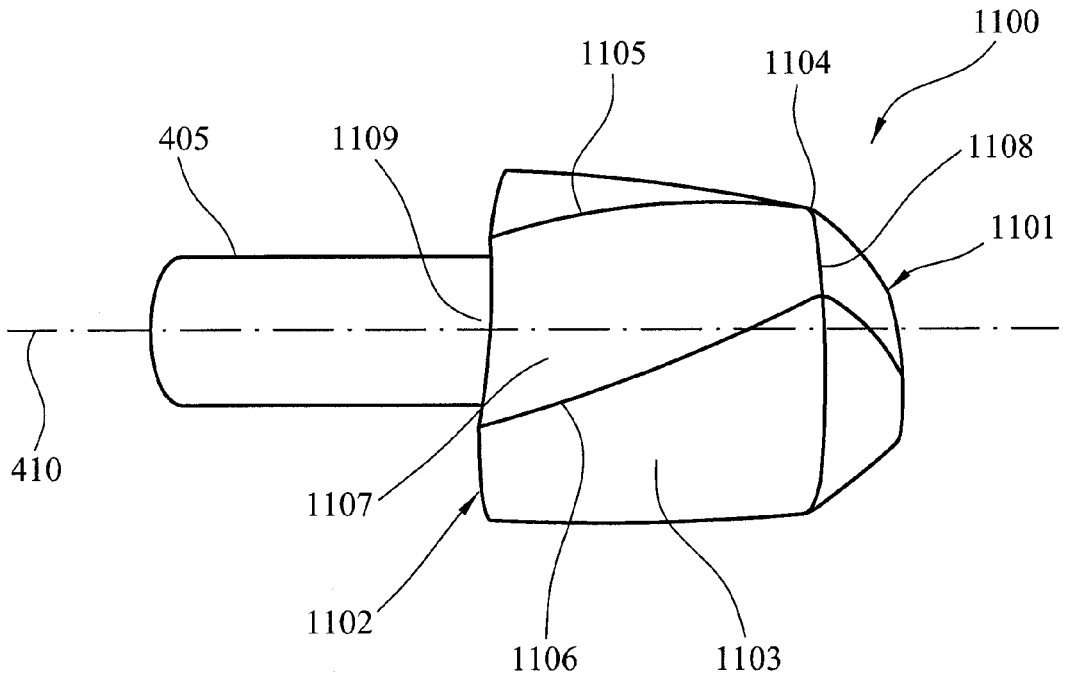
FIG. 11 is a side perspective view of a further embodiment of the present invention illustrating one of the clamping heads having a twisted main length according to a specific implementation.
Figure 12:
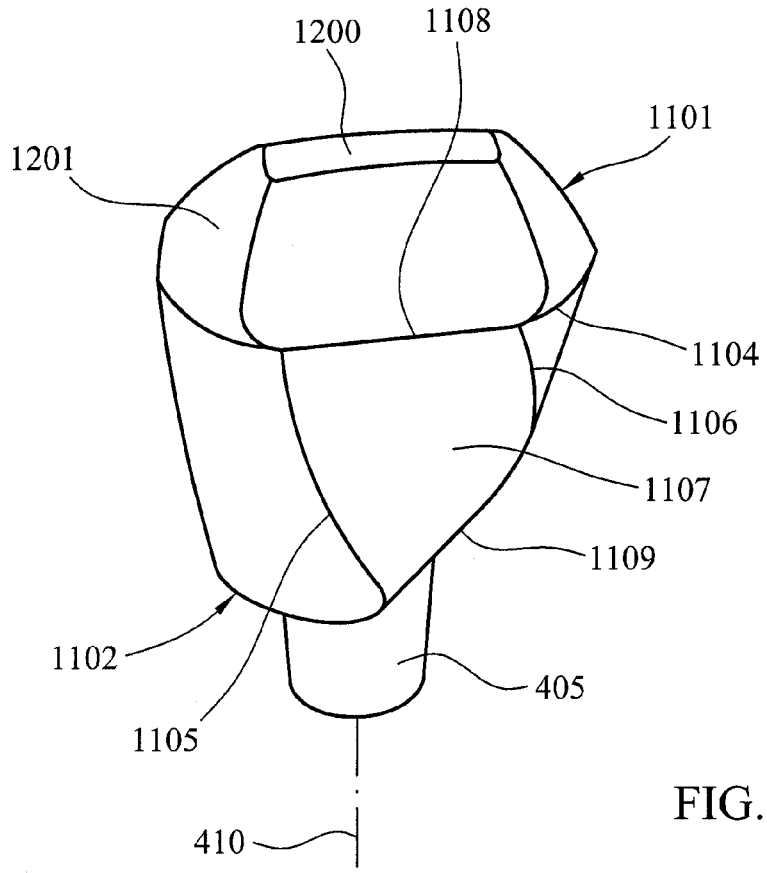
FIG. 12 is an upper perspective view of the clamping head of FIG. 11.

As indicated, spring 600 ensures each clamping head 403, 404 is maintained in the clamped position to prevent unwanted decoupling. However, interconnector 400 comprises a mechanical lock (latch) mechanism that overrides the automatic or semi-automatic twist lock function. The lock mechanism comprises a lock recess 508 in the external facing surface of housing 401 towards one end of elongate slot 408. A second component of the lock mechanism is provided by a shape profile of an innermost facing region of handle 407 and in particular keying elements 1001 oriented to be facing towards housing 401. With the handle 407 in position D of FIG. 10, keying elements 1001 abut against the sides of recess 508 such that handle 407 is prevented from being received within recess 508 as shown in FIG. 9. Upon clockwise rotation 1000 of handle 407, keying elements 1001 are aligned to sit within elongate groove 408 which, in turn, allows handle 407 to drop radially inward within recess 508. In this orientation, actuator arm 406 is prevented from circumferential travel within elongate slot 408 and the clamping heads 403, 404 are, in turn, prevented from axial rotation about longitudinal axis 410. Automatic disengagement of the interconnector 400 from each respective corner fitting 102 is thereby prevented. The same keying elements 1001 are configured to abut respective sides of recesses 607, 608 that are similarly shaped to recess 508 to provide secured latching of handle 407 and arm 406 at positions B and C. This configuration functions to lock the respective clamping heads 404, 403 in respective entry positions at apertures 303.

Importantly, the rotational displacement of head 403 about axis 410 between the loading stage of FIG. 8 and the clamped orientation of FIG. 9 is automatic or semi-automatic. Accordingly, an operator is not required to manually displace actuator arm 406 from position A to B during coupling. As described, this significantly reduces the operational safety hazards associated with coupling the freight containers 100, 101 particularly at the elevated corners of each coupling face.

As will be appreciated, the freight containers 100, 101 may be decoupled by the reverse operation described with reference to FIGS. 7 to 10 by an operator displacing actuator arm 406 circumferentially within slot 408 against the force of spring 600. In particular, handle 407 and arm 406 are rotated from position A to position B such that head 403 is releasably locked in the entry position with side walls 513 aligned substantially parallel to edges 305 of aperture 303. Container 100 may then be decoupled from the interconnector 400. Handle 407 and arm 406 are then rotated further to position C to bring head 404 into the entry position with side edges 514 aligned parallel to edges 305 of aperture 303. The interconnector 400 is then decoupled from the first container 101.

FIGS. 11 to 16B illustrate a further embodiment of the present invention. The further embodiment differs from the embodiments of FIGS. 4 to 10 by way of the shape and configuration of the second clamping head 403. A further difference is that housing 401 is devoid of a latching recess 608 at position B referring to FIGS. 5 and 6. Accordingly, handle 407 and arm 406 are capable of rotation in both directions from position A to position C without the possibility of latching at intermediate position B. This is detailed further with reference to FIGS. 15A to 16B.

According to the further embodiment, clamping head 1100 is substantially elongate in the longitudinal axis direction 410 and comprises a domed engaging end 1101 positioned furthest from shaft 405. Domed end 1101 is substantially elongate in a plane extending perpendicular to axis 410 and comprises an endmost strip or elongate shoulder 1200 that represents a peak of a sloping side region 1201. Region 1201 is bordered by a base region 1104 that is defined, in part, by a pair of parallel elongate edges 1108. The shape profile of the dome base 1104 corresponds approximately to the oval shape profile of aperture 303. Additionally, a cross sectional size of oval region 1104 is slightly less than that of aperture 303 to allow end 1101 to be received within aperture 303.

A main body 1103 extends from dome base 1104 along axis 410. Body 1103 is twisted along its length. Accordingly, the oval shape profile of dome base 1104 creates four camming regions that follow helical turns about axis 410. A first pair of ridges 1105, 1106 are provided on one side of the main body 1103 and a corresponding pair of ridges extend on the opposite side of body 1103. A concave surface 1107 extends between each pair of ridges 1105, 1106. Main body 1103 terminates at a head base region 1102. The base region 1102 comprises an identical or similar shape profile to the oval region 1104 of domed end 1101 and comprises in particular the pair of parallel side edges 1109 that extends perpendicular to axis 410. Accordingly, a width of main body 1103 between base end 1102 and engaging end 1101, not withstanding the longitudinal twist, is substantially uniform in the axial direction 410.

Each pair of camming ridges 1105, 1106 and a surface profile of main body 1103 at each sides of these ridges 1105, 1106 are configured to cam against the inner facing parallel edges 305 (that define aperture 303 extending through the body of the corner fitting 102) and cause head 1100 to rotate about axis 410 as it is advanced through aperture 303 into corner fitting interior 302. Main body 1103 is twisted about axis 410 by approximately 15° and this in turn provides a 15° axial rotation of shaft 410 and the first clamping head 404 as head 1100 passes through aperture 303 in a coupling and decoupling operation. Importantly, the domed engaging end 1101 is positioned at shaft 405 relative to first clamping head 404 such that the domed engaging end 1101 is aligned to enter aperture 303 and not to contact the external facing wall 300 at a region of edges 305 as with the previous embodiment described with reference to FIGS. 4 to 10. The embodiment of FIGS. 11 to 16B is configured to enter aperture 303 initially and then to rotate.

Figure 13:
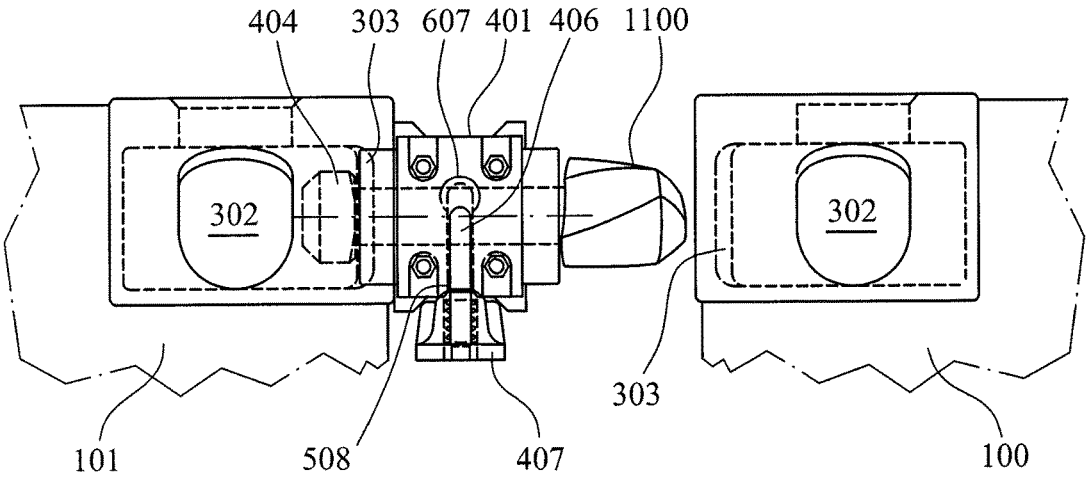
FIG. 13 illustrates the interconnector arrangement of FIG. 7 with the clamping head of FIG. 11 in intermediate position between two partially coupled corner fittings of respective containers.
Figure 14:
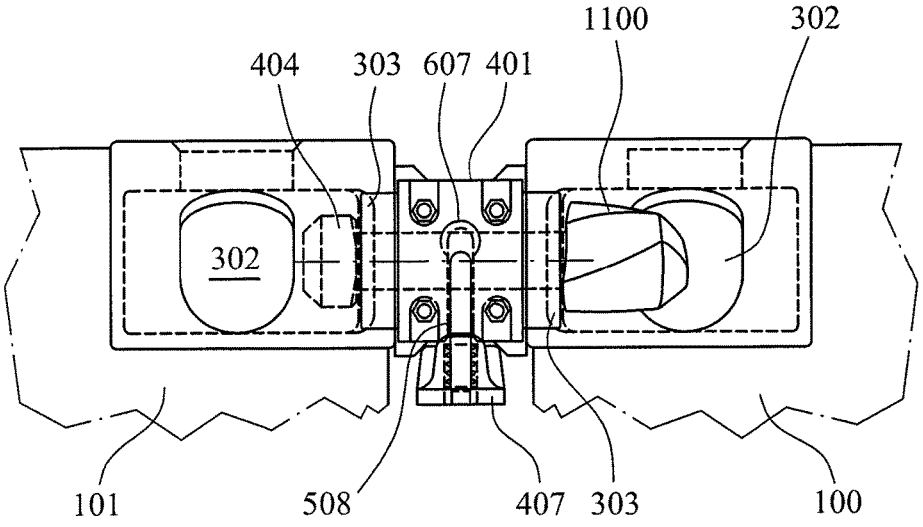
FIG. 14 illustrates the complete coupling of the adjacent containers via the interconnector of FIG. 13.

As illustrated in FIGS. 13 and 14, housing 401 is devoid of the second latch recess 608 such that arm 406 and handle 407 may be latched at position C only and to move freely between positions A and C under the return force of spring 600. FIG. 13 illustrates the interconnector coupled to freight container 101 but not second container 100. FIG. 14 illustrates the two containers 100, 101 releasably coupled together with the clamping heads 404, 1100 in their respective clamping positions.

Figure 16B:
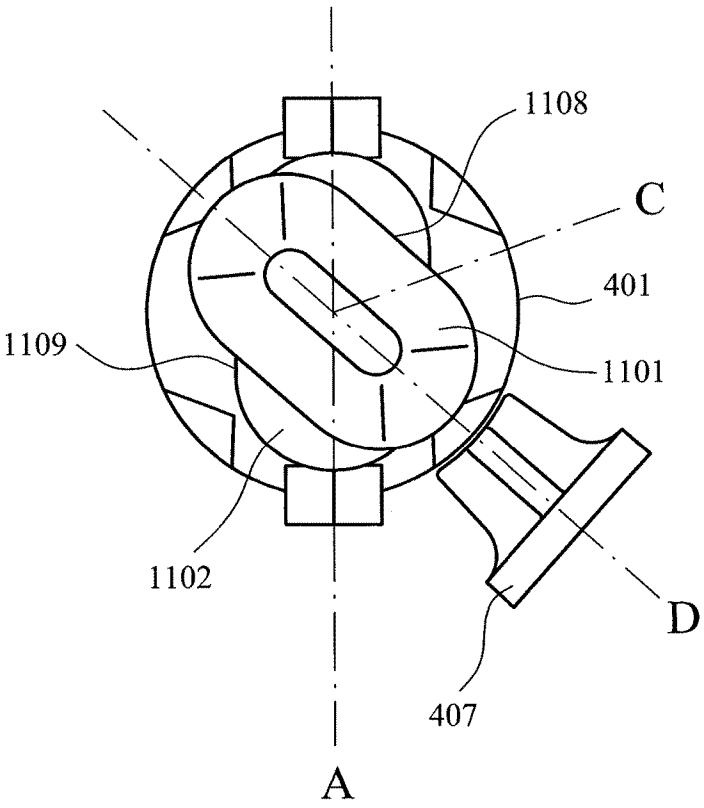
FIG. 16B is a right side end view of the interconnector of FIG. 16A with the twist clamping head in an intermediate position at the final stage of insertion within the corner fitting.
Figure 16A:
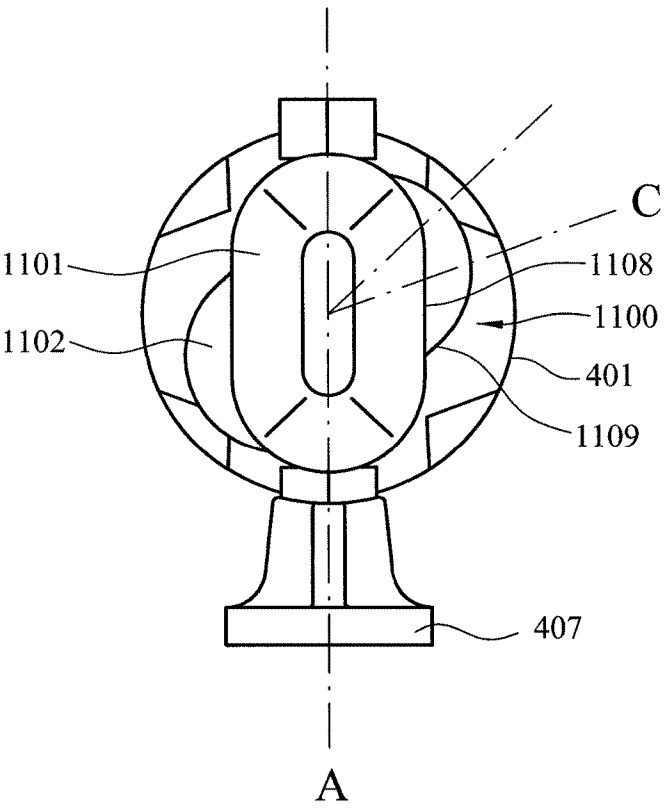
FIG. 16A is a right side end view of the interconnector of FIG. 14 with a twist clamping head in an aperture entry position.

The coupling and decoupling operation is described with reference to FIGS. 15A to 16B and is similar to the procedure described with reference to FIGS. 7 to 10B. In a coupling operation, handle 407, by default is maintained at position A under the force of spring 600 as shown in FIG. 15A. Handle 407 is then rotated to position C such that head 401 is aligned substantially vertically with side edges 513 aligned parallel to the side edges 305 of aperture 303. Handle 407 is retained in this position by latching into recess 800 formed within housing 401. As described with reference to the previous embodiment, this latching is provided by a rotation of handle 407 about axis 606. With head 404 in the orientation of FIG. 15B, head 404 is allowed to pass through aperture 303 and into interior 302. Handle 407 is then delatched by rotation about axis 606 to return to position A as shown in FIG. 15A. Head 404 is accordingly aligned substantially perpendicular to side walls 305 as shown in FIG. 13. In this alignment, the second clamping head 1100 is aligned as shown in FIG. 16A with the domed end 1101 aligned substantially vertically and the head base 1102 orientated tangentially at around 15° from vertical. In this orientation, domed engaging end 1101 is allowed to pass into aperture 303 as the first container 100 is moved into coupling position. Camming ridges 1105, 1106 contact the inner facing surfaces of aperture edges 305 to cause head 1100 to rotate as it passes through aperture 303. During this rotation, shaft 405, handle 407 and head 404 are rotated to a position (corresponding to handle position D of FIG. 16B) until the head base 1102 is aligned substantially vertically. Once head 1100 has cleared aperture 303 handle 407 is returned from position D to position A automatically by spring 600. The interconnector is now locked to the first and second containers 100, 101. Handle 407 may be locked in position A by the mechanism and procedure described with reference to FIG. 10 being identical to the previous embodiment.

Figure 15B:
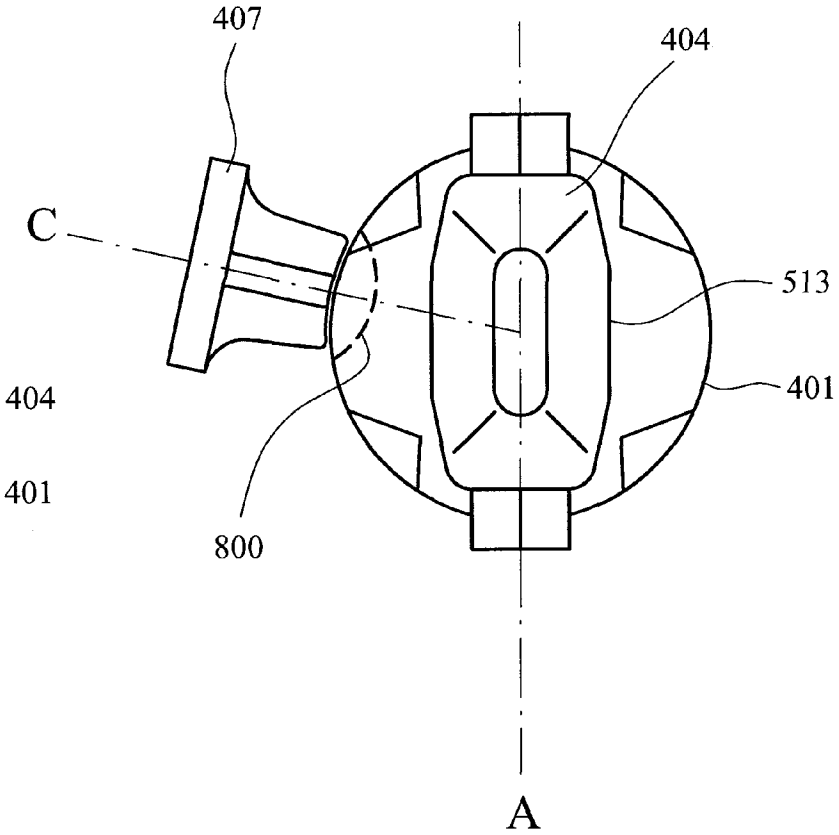
FIG. 15B illustrates a left side end view of the interconnector of FIG. 15A with the first clamping head in an aperture entry position.
Figure 15A:
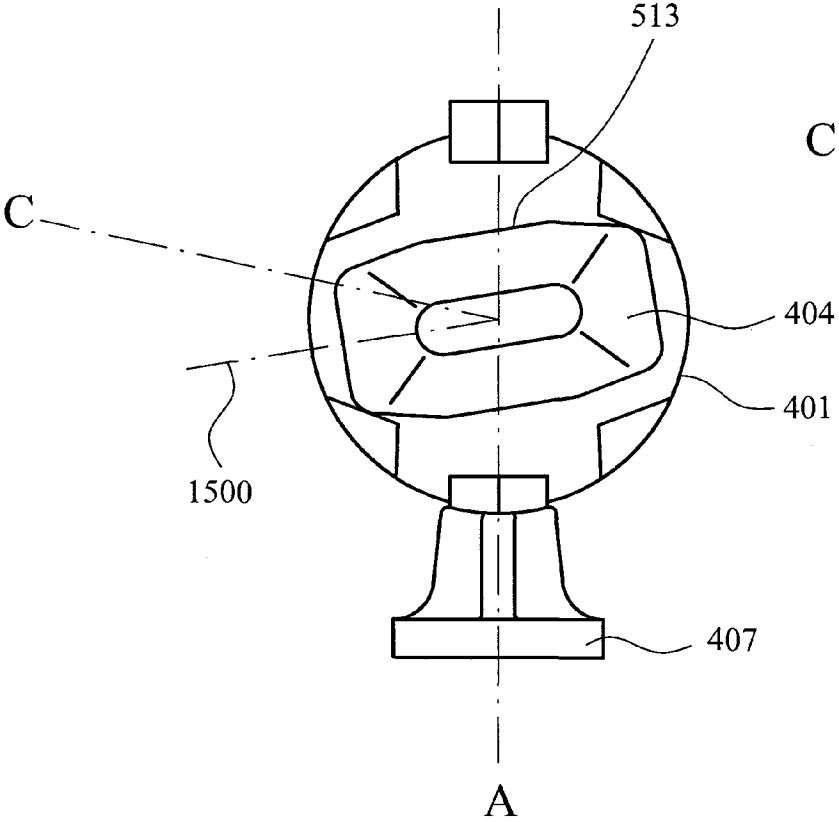
FIG. 15A illustrates a left side end view of the interconnector of FIG. 14 with a first clamping head in a locked position.

To decouple containers 100, 101, handle 407 is rotated and released from the locking position A and rotated (relative to axis 410) through slot 408 to position C where it is latched into recess 800 as shown in FIG. 15B. With head 404 aligned to clear aperture 303, second container 101 may be decoupled from head 404 whilst head 1100 maintains the couple with container 100. The entire interconnector, including housing 401 and head 1100 may then be rotated manually (without independent rotation of head 1100 relative to housing 400) to align head base 1102 with aperture 303. The entire interconnector is then rotated to effectively unscrew head 1100 from corner fitting 102. Alternatively, handle 407 is rotated (relative to axis 410) within slot 408 to bring head base 1102 to the position shown in FIG. 16B and then the interconnector pulled from corner fitting 102 as handle 407 is rotated from position B to position A to complete the decoupling from container 100.

The invention claimed is:

1. An interconnector for coupling two adjacent corner fittings of two respective freight containers end-to-end or side-by-side, where each of the corner fittings has a hollow interior and an entry aperture to receive a part of the interconnector within the hollow interior, the interconnector comprising:

a rotatable shaft;

a housing in which the rotatable shaft is housed and capable of rotation about its longitudinal axis;

a first and second clamping head provided at each respective end of the shaft, each head being rotatable about the longitudinal axis of the shaft by rotation of the shaft between a respective head entry position in which each head can pass into the respective entry aperture and a clamping position in which each head is retained within the respective hollow interior of the corner fitting;

a bias actuator to bias the clamping heads to the clamping positions;

wherein the second clamping head comprises a domed engaging end and a head base end that are elongate in a plane perpendicular to the longitudinal axis, the engaging end separated from the base end by a main body that extends in the longitudinal axis direction, the main body being twisted along its length to provide at least one camming ridge extending between the engaging end and the base end; and wherein an angular orientation of the elongate domed engaging end in the plane perpendicular to the longitudinal axis is different to the angular orientation of the elongate base end in the plane perpendicular to the longitudinal axis.

2. The interconnector as claimed in claim 1 wherein a base of the domed engaging end is defined, in part, by a pair of elongate substantially parallel edges.

3. The interconnector as claimed in claim 2 wherein the head base end is defined, in part, by a pair of elongate substantially parallel edges wherein the angular orientation of the elongate edges of the engaging end is different to the angular orientation of the elongate edges of the head base end in the respective planes perpendicular to the longitudinal axis.

4. The interconnector as claimed in claim 1 comprising at least two camming ridges extending in the longitudinal axis between the engaging end and the head base end, a first ridge provided on a first side of the second clamping head and a second ridge provided on a second side of the second clamping head.

5. The interconnector as claimed in claim 1, wherein the at least one camming ridge comprises four camming ridges that extend in the longitudinal axis between the engaging end and the head base end.

6. The interconnector as claimed in claim 1 wherein the main body is twisted in the longitudinal axis between the engaging end and the head base end by an angle in the range 10 to 30°.

7. The interconnector as claimed in claim 1 wherein the main body is twisted in the longitudinal axis between the engaging end and the head base end by an angle in the range 13 to 18°.

8. The interconnector as claimed in claim 1 wherein the at least one ridge follows a helical turn about the longitudinal axis.

9. The interconnector as claimed in claim 1 wherein a width of the main body in a direction perpendicular to the longitudinal axis between the engaging end and the head base end is substantially uniform.

10. The interconnector as claimed in claim 1 wherein a length of the elongate engaging end in a direction perpendicular to the longitudinal axis is substantially equal to a length of the elongate head base end in a direction perpendicular to the longitudinal axis.

11. The interconnector as claimed in claim 1 wherein a cross sectional area of the main body at the head base end is substantially equal to a cross sectional area of an opposite end of the main body at the interface with the domed engaging end.

12. The interconnector as claimed in claim 1 wherein a length in the longitudinal axis of the main body is substantially equal to a length of the elongate domed engaging end in the plane perpendicular to the longitudinal axis.

13. The interconnector as claimed in claim 1 wherein the housing comprises a barrel, the shaft being rotatably housed within the barrel, the interconnector further comprising:

a slot extending through the housing in a direction transverse or perpendicular to the shaft; and an actuator arm projecting from the shaft and radially outward through the housing via the slot, the actuator arm capable of reciprocating movement within the slot as the shaft rotates within the barrel.

14. The interconnector as claimed in claim 13 comprising a latch to releasably retain the first clamping head in the entry position to allow the interconnector to be decoupled from the respective corner fitting.

15. The interconnector as claimed in claim 14 wherein the latch comprises a first latch component provided at the housing and a second latch component provided at the actuator arm such that on engagement of the first and second latch components, the actuator arm is locked in position at the housing and the shaft is prevented from rotation.

* * * * *